United States Patent [19]

Porowski et al.

[11] Patent Number: 4,683,014

[45] Date of Patent: Jul. 28, 1987

[54] MECHANICAL STRESS IMPROVEMENT PROCESS

[75] Inventors: Jan S. Porowski, Pittsburgh; William J. O'Donnell, Bethel Park; Manu L. Badlani, Pittsburgh; Edward J. Hampton, Murrysville, all of Pa.

[73] Assignee: O'Donnell & Associates, Inc., Pittsburgh, Pa.

[21] Appl. No.: 845,863

[22] Filed: Mar. 28, 1986

[51] Int. Cl.[4] ..... C21D 7/02

[52] U.S. Cl. ..... 148/131; 148/4; 228/199

[58] Field of Search ..... 148/4, 131, 127, 1; 228/104, 203, 199; 29/421 R

[56] References Cited

U.S. PATENT DOCUMENTS

| | | | |
|---|---|---|---|
| 2,162,229 | 6/1939 | Remington | 148/131 |
| 3,625,586 | 12/1971 | Verdier | 29/421 R |
| 4,018,634 | 4/1977 | Fencl | 148/131 |
| 4,342,609 | 8/1982 | Beatovic et al. | 148/127 |

FOREIGN PATENT DOCUMENTS

| | | |
|---|---|---|
| 0014158 | 6/1980 | European Pat. Off. . |
| 1000133 | 8/1965 | United Kingdom . |
| 1097571 | 1/1968 | United Kingdom . |
| 1217803 | 12/1970 | United Kingdom . |
| 1235106 | 6/1971 | United Kingdom . |
| 2071552 | 9/1981 | United Kingdom . |
| 2048146 | 12/1982 | United Kingdom . |
| 0474564 | 9/1975 | U.S.S.R. . |
| 0779422 | 11/1980 | U.S.S.R. . |

*Primary Examiner*—L. Dewayne Rutledge
*Assistant Examiner*—S. Kastler
*Attorney, Agent, or Firm*—Joseph J. Carducci

[57] ABSTRACT

A process is claimed for removing the residual tensile welding stresses in the inner layer of the weld metal and the heat-affected zone of steel piping elements that have been butt-welded to each other end-to-end by means of a circumferential weld. The process involves mechanically introducing circumferential compressive stresses in the piping elements by applying a radial load inwardly on a section of at least one of the piping elements away from the weld such that the distance from the midplane of the section of the piping element upon which the radial load is applied to the weld midplane is equal to about two to about 12 times the thickness of the piping element upon which the radial load is applied. The distance from the edge of the section of the piping element upon which the radial load is applied that is adjacent the weld to the weld midplane is at least equal to about one-half the thickness of the piping element upon which the load is applied. The amount of the radial load applied is sufficient to permanently reduce the outside diameter at the midplane of the section of the piping element in the range of about 0.2 to about 2.0 percent.

15 Claims, 6 Drawing Figures

MECHANICAL STRESS IMPROVEMENT PROCESS

CROSS-REFERENCE TO RELATED APPLICATIONS

U.S. patent application Ser. No. 582,617 of William J. O'Donnell and Jan S. Porowski for Mechanical Stress Improvement Process, filed Feb. 22, 1984, and U.S. patent application Ser. No. 718,439 of William J. O'Donnell and Jan S. Porowski for Mechanical Stress Improvement Process, filed Apr. 1, 1985.

BACKGROUND OF THE INVENTION

1. Field of the Invention

This invention relates to a process for removing the residual tensile welding stresses in the inner layer of the weld metal and heat-affected zone (HAZ) of steel piping elements that have been butt-welded to each other end-to-end by means of a circumferential weld.

2. Description of the Prior Art

When piping is butt-welded together by means of a circumferential weld, significant residual tensile welding stresses are produced in the weld metal and in the heat-affected zone of said piping. These tensile stresses tend to enhance stress corrosion cracking in the welded region and the resulting crack propagation in the weld metal and in the heat-affected zone of such piping.

Stress corrosion cracking in stainless steel piping has been a serious drawback in boiling water nuclear reactor (BWR) plants in the United States and elsewhere in the world. Mitigating remedies have included hydrogen addition to the water in the pipes, the use of improved welding techniques and the use of better materials in the preparation of the steel piping. However, the occurrence of cracks have not been fully eliminated or significantly reduced in BWR plants.

Induction heating stress improvement (IHSI) is one method currently being used to improve residual welding stresses in pipes and shells. However, the IHSI process cannot induce net compressive forces through the weld in either the axial or circumferential direction. Equilibrium of the axial compressive stresses due to the IHSI process induces axial tensile stresses such that the net axial force in every cross-section is zero. Indeed, through-the-wall bending stresses are induced during the IHSI process. Weld defects, such as inclusions, porosity, lack of fusion, hot tears, etc., and stress corrosion or fatigue cracks, are therefore subjected to high tensile stresses during the process. The resulting crack opening, fatigue cracking and creep crack propagation increases exposure to the corrosive media and reduces the remaining strength and endurance of the piping and makes it more susceptible to further cracking and leaking. Our Improved Mechanical Stress Improvement Process is an improved process in that high tensile stresses are not induced in the welded region of the piping during the claimed process, thus eliminating the potential deleterious effects of the IHSI tensile stresses.

Numerous procedures have been employed to improve the physical and/or mechanical properties of materials that have been welded to each other. Verdier in U.S. Pat. No. 3,625,568 and British Pat. No. 1,217,803 relieves tensile stresses in a welded joint by subjecting the weld to a compressive force. In U.S. Pat. No. 4,018,634 Fencl strain hardens a pipe having a longitudinal seam by decreasing the diameter of the pipe along its entire length by at least 1.5 percent and thereafter subjecting the treated pipe to a heat operation. Beatovic et al in U.S. Pat. No. 4,342,609 and European Pat. No. A1 0014158 lower tensions arising from a welding operation by detonating an explosive charge placed over the weld area. Howd et al in British Pat. No. 1,235,106 and Loosemore et al in British Pat. No. 2,071,552 also use an explosive charge. Avesta in British Pat. No. 1,000,133 subjects a vessel containing cold-worked welded plates, while at a temperature below the recrystallization temperature of the steel plates, to an internal fluid pressure to obtain a substantially uniform strength in the vessel. Davies et al in British Pat. No. 1,097,571 subjects a tube containing a longitudinal seam to swaging to reduce its wall thickness and then to heat treatment to effect recrystallization of the structure. Malik in British Pat. No. 2,048,146 improves the physical properties of weldments by heating the same to a very high temperature while simultaneously applying substantial isostatic pressure thereto. In Russian Pat. No. 474,564 to PATM low-alloy steel welds have been heated to their austenitic temperatures and submitted to deformation. UDOD in Russian Pat. No. 779,442 subjects a welded structure to peening by directing shot blasts at an angle of 70°.

SUMMARY OF THE INVENTION

We have found that we can remove residual tensile welding streses in the inner layer of the weld metal and of the heat-affected zone of steel piping elements that have been butt-welded to each other end-to-end by means of a circumferential weld which comprises mechanically introducing circumferential compressive stresses in said piping elements by applying a radial load inwardly on a section of at least one of said piping elements away from said weld such that the distance from the midplane of said section of said piping element upon which said radial load is applied to the weld midplane is equal to about two to about 12 times the thickness of said piping element upon which said radial load is applied, the distance from the edge of said section of said piping element upon which said radial load is applied that is adjacent said weld to the weld midplane being at least equal to about one-half the thickness of said piping element upon which said load is applied, the amount of said radial load being applied being sufficient to reduce the outside diameter at the midplane of said section of said piping element in the range of about 0.2 to about 2.0 percent.

BRIEF DESCRIPTION OF THE INVENTION

Figure 1:
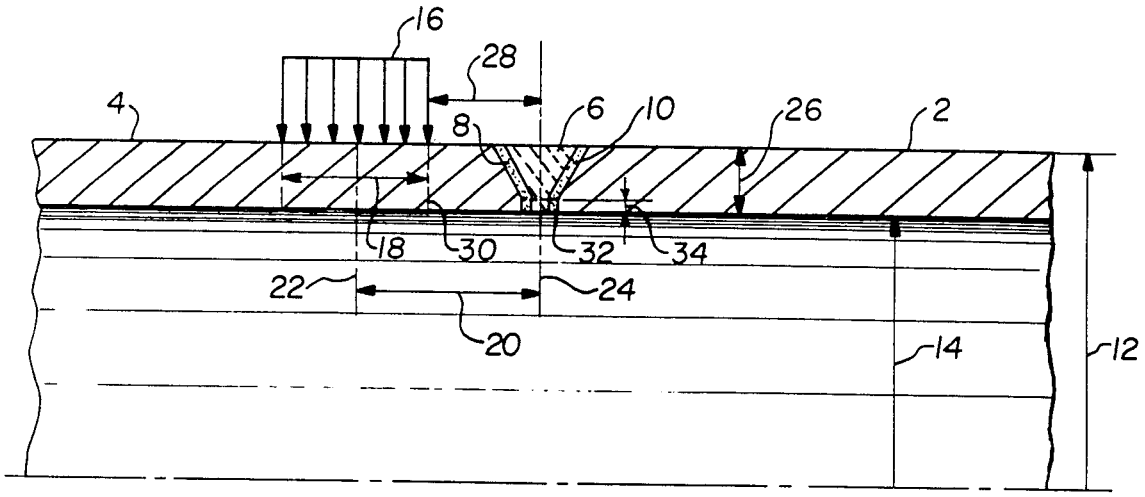
FIG. 1 is a schematic representation of a portion of two steel piping elements that have been butt-welded to each other end-to-end by means of a circumferential weld.

Referring to FIG. 1, there is shown therein steel pipes 2 and 4 that have been butt-welded to each other end-to-end by means of a circumferential weld 6. Immediately adjacent to said weld 6 are heat-affected zones 8 and 10 in steel pipes 4 and 2, respectively. The pipes 2 and 4 are shown to have an outer diameter 12 and an inner diameter 14.

In accordance with the process defined and claimed herein, circumferential compressive stresses are mechanically introduced in steel pipes 2 and 4 by applying a radial load 16 inwardly on the outer surface of at least one of said steel pipes. As shown in FIG. 1, radial load 16 is applied on section 18 of steel pipe 4.

It is critical in carrying out the process defined and claimed herein that the radial load be applied to a section of said steel pipes away from said weld 6, such that no portion of said radial load be applied directly onto said weld 6, and that the outer diameter of said section of the pipe upon which said radial load is applied be reduced within critically defined limits. More specifically, the distance 20 from the midplane 22 of section 18 to the midplane 24 of weld 6 is equal to about 2 to about 12, preferably about three to about eight times the wall thickness 26 of steel pipe 4. The distance 28 from the edge 30 of section 18 that is adjacent weld 6 to the weld midplane 24 is at least equal to about one-half of the wall thickness 26 of steel pipe 4, preferably about two to about four times the wall thickness 26 of steel pipe 4.

The welding process generates residual tensile stresses in the weld metal 6, heat-affected zones 8 and 10 and in the adjacent base metal of steel pipes 2 and 4. These stresses enhance stress corrosion cracking, particularly in the inner layer 32 of the weld metal 6 and heat-affected zones 8 and 10, whose surface is in direct contact with the medium flowing through steel pipes 2 and 4. This medium, for example, boiler feed water, also contributes to stress corrosion cracking. The thickness of 34 of the said inner layer 32 is equal to at least about 1/10 of the wall thickness 26 of steel piping 4, but usually less than about one-half the wall thickness of steel piping 4.

When a radial load 16 is applied to section 18 of pipe 4, as described above, resulting in the permanent decrease of the outer pipe diameter at the midplane 22 of section 18 in the range of about 0.2 to about 2.0 percent, preferably about 0.5 to about 1.2 percent, residual welding stresses will be removed in inner layer 32 of the weld metal 6 and the heat-affected zones 8 and 10 and will be either removed or reduced in the remaining portions of the weld metal 6 and the heat-affected zones 8 and 10 and the base metal in pipes 2 and 4 immediately adjacent to heat-affected zones 8 and 10. The amount of compressive stresses introduced into pipes 2 and 4 herein by the radial load 16 must be sufficiently high to cause plastic flow of the pipe material beneath radial load 16, resulting in the permanent reduction of the pipe diameter in section 18, as defined above, within the range of about 0.2 to about 2.0 percent. Generally, the plastically deformed zone, during the application of said radial load, extends further along the pipe 4 to include weld 6 and heat-affected zones 8 and 10. For example, in boiling water reactor piping systems, the amount of radial load needed to effect the above can correspond to about 5,000 to about 10,000 pounds per square inch gauge pressure applied to the outside surface of section 18. After these compressive stresses have been applied, and the diameter of the pipe 4 has been permanently reduced, as defined above, the residual tensile welding stresses will have been redistributed so that after removal of said radial load, residual tensile welding stresses, in both the axial and circumferential (hoop) direction, in said inner layer 32 are removed.

Figure 2:
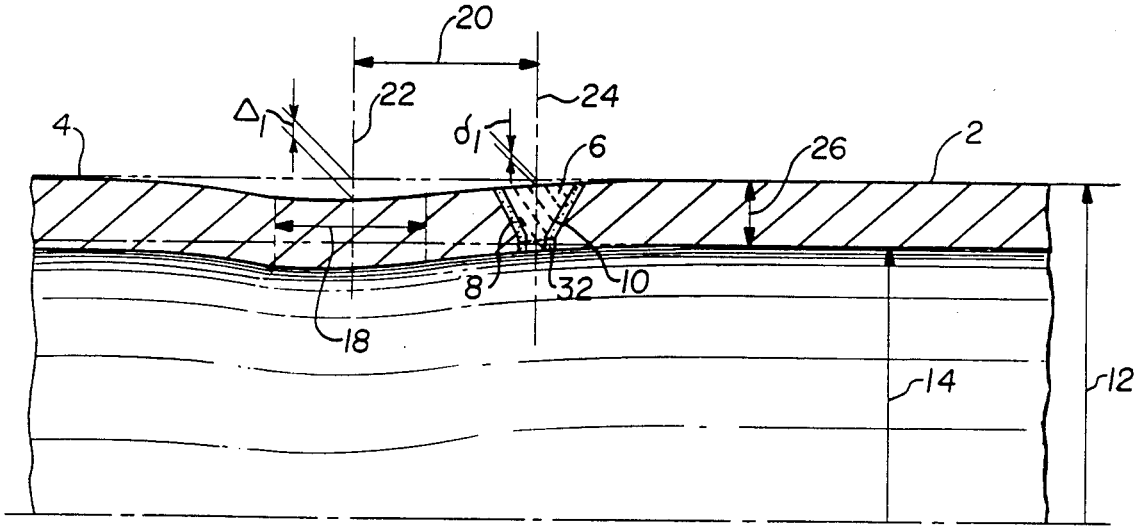
FIG. 2 is a schematic representation of a portion of two steel piping elements that have been butt-welded to each other end-to-end by means of a circumferential weld wherein a radial load has been applied to one of said piping elements away from said weld.

FIG. 2 is a schematic representation illustrating the contour of the welded pipes 2 and 4 after application of radial load 16 on pipe 4, in accordance with the scheme of FIG. 1, and the subsequent removal thereof. Note that the percent of permanent contraction $\Delta_1$ of pipe 4 at the midplane 22 of section 18 is greater than the percent of permanent contraction $\delta_1$ at the midplane 24 of weld metal 6.

Figure 3:
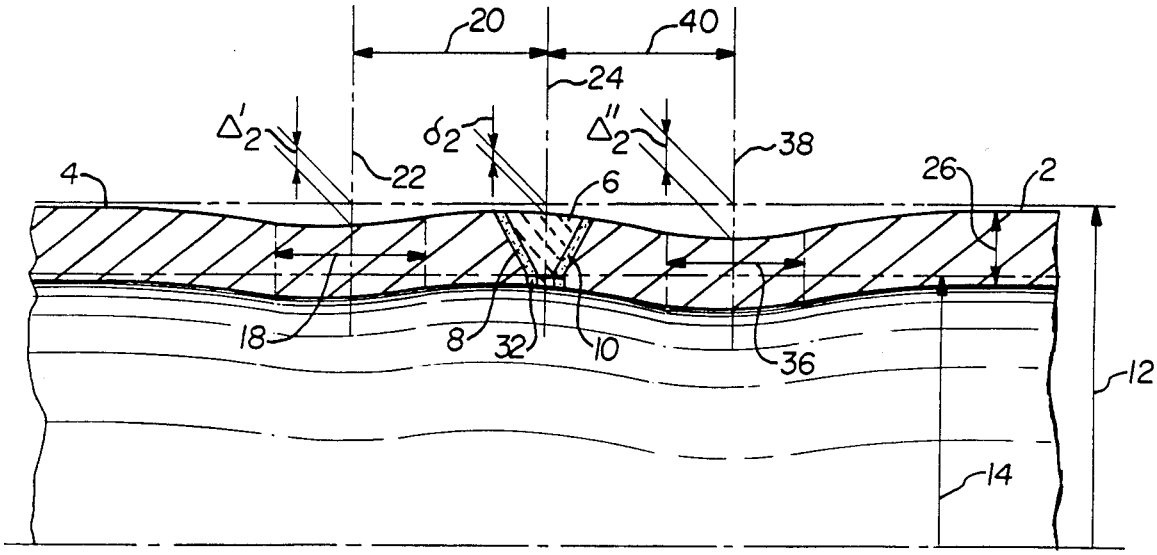
FIG. 3 is a schematic representation of a portion of two steel piping elements that have been butt-welded to each other end-to-end by means of a circumferential weld wherein a radial load has been applied to each of said piping elements away from said weld.

FIG. 3 is a schematic representation illustrating the contour of the welded pipes 2 and 4 after application of radial loads to section 18 of pipe 4 and to section 36 of pipe 2, in accordance with the scheme of FIG. 1, and the subsequent removal of the radial loads therefrom. Note again that the percent of permanent contractions $\Delta_2'$ and $\Delta_2''$ at the midplanes 22 and 38 of sections 18 and 36 of pipes 4 and 2, respectively, are greater than the percent of permanent contraction $\delta_2$ at the midplane 24 of weld metal 6. The distance 40 from the midplane of weld 6 to the midplane of section 36 need not be equal to distance 20, provided each falls within the limits defined hereinabove. As shown from the contour of welded pipes 2 and 4 in FIG. 3, the reductions in pipe diameters in sections 18 and 36 need not be equal to each other as long as each falls within the limits defined herein. While the wall thicknesses of pipes 2 and 4 are shown to be equal to each other in FIG. 1, it is understood that the wall thicknesses in said pipes, or piping elements, need not be the same.

Figure 4:
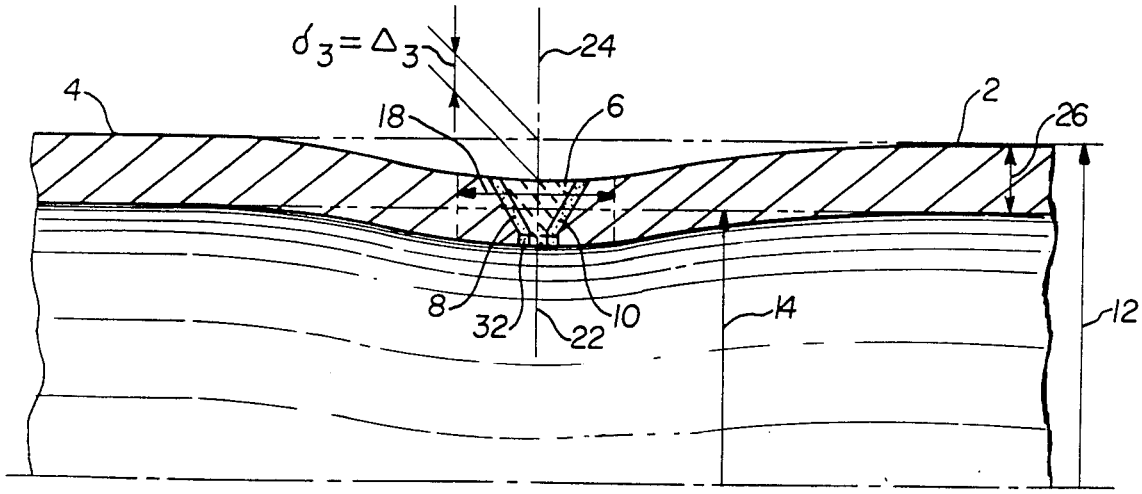
FIG. 4 is a schematic representation of a portion of two steel piping elements that have been butt-welded to each other end-to-end by means of a circumferential weld wherein a radial load has been applied upon the weld and to the immediate surrounding portions of said piping elements.

The results illustrated in FIGS. 2 and 3 are to be contrasted with those obtained in FIG. 4, wherein the radial load 16 has been applied to the weld metal 6, heat-affected zones 8 and 10 and in the base metal in pipes 2 and 4 immediately adjacent thereto. In this case the percent of permanent contraction $\Delta_3$ at the midplane 22 of section 18 is equal to the percent of permanent contraction $\delta_3$ at the midplane 24 of weld metal 6.

A comparison of the contours of the welded pipes FIGS. 2, 3 and 4 illustrates the criticality of applying a radial load on at least one of the pipes away from the weld (FIGS. 2 and 3) rather than on the weld surface (FIG. 4). In FIG. 4 the maximum contraction of the welded pipe occurs at the weld midplane, $\Delta=\delta$, and therefore the inner surface, or layer, 32 of the pipe at the weld location becomes convex, indicating that the residual axial stress at such location remains tensile. In contrast, in FIGS. 2 and 3 maximum contraction of pipe occurs away from the weld midplane, $\Delta\neq\delta$, and therefore the inner surface of the pipe at the weld location inverts to become concave, indicating that the residual axial stress at such location is compressive. Thus, while the application of a radial load to the weld location (FIG. 4) does not result in the removal of residual tensile welding streses in the inner surface of the pipe at the weld location, the application of a radial load on at least one of the pipes away from the weld (FIGS. 2 and 3) does remove residual tensile welding stresses in the inner surface of the pipe at the weld location.

For purposes of the process defined and claimed herein, the following definitions will provide a better understanding thereof. By "steel piping,"we mean to include pipes, connecting fittings, such as elbows and tee fittings or reducers, etc., intended to convey fluids, often under elevated pressures, from one point to another. The steel piping that is welded to each other herein need not be on the same thickness nor composed of the same materials. The piping for Boiling Water Reactor Plants can range, for example, in outer diameters of about 4 to about 28 inches and wall thicknesses of about 0.25 to about 1.5 inches. The piping herein is made of steel, that is, of a malleable alloy of iron and carbon, usually containing other elements, such as molybdenum, nickel, chromiuim, manganese, etc. An example of such steel is stainless steel, such as steel of the type 304, 316, 347, etc. "Weld metal" is the metal constituting the fused zone joining the ends of two adjacent pipe ends or fittings to each other. An example of a suitable weld metal is stainless steel of the type 308. By "heat affected zone" we mean that portion of the piping immediately adjacent to the weld metal wherein the temperature rise during welding affects the grain structure of the metal of said piping. In general, the axial length of said heat-affected zone does not exceed the wall thickness of the welded piping at the weld. The "adjacent base metal" is that portion of the piping immediately adjacent to the heat-affected zone extending axially away from the heat-affected zone a distance not exceeding 2.0 $\sqrt{Dt}$, wherein t is the wall thickness of the piping and D is the outer diameter of the piping. "Residual welding stresses" are those stresses that remain in a weldment without external loading after the heat energy of welding has been dissipated. The plastic deformation induced in the metal by welding heat is the principal cause of residual stresses in weldments. "Weldments" include the weld metal, the heat-affected zone and, in some cases, the adjacent base metal.

The mechanical means used for applying the desired radial load on a section of the steel piping elements herein, as defined above, are not critical, provided such means are sufficient to obtain and control the defined permanent reduction in the diameter of the steel piping element(s). In a preferred embodiment, for example, the mechanical means can comprise a pair of split rings whose inner surfaces are contoured to the outside surface of the section of the steel piping that is to be contracted, as defined herein, and means to force said rings onto said section of said steel piping to contract the same. The maximum movement of the split ring halves toward each other can be limited using shims inserted at the split locations. The inner surfaces of the split rings can be lined with a crushable insert, for example, made of an indented or waffled steel sheet, which adjust to the actual cross-section of the steel piping. A means for imposing the desired contraction can be obtained, for example, by providing the adjacent ends of said split rings with aligned, tangential openings and bolts disposed in said openings, by means of which the halves of said split rings can be forced toward each other.

DESCRIPTION OF PREFERRED EMBODIMENT

An elastic-plastic analysis was made in order to show the criticality of placing a radial load on a section of pipe that has been butt-welded end-to-end to another such pipe by means of a circumferential weld away from the weld rather than on the weld itself. The pipes welded to each other were each composed of 304 stainless steel having an inner diameter of 11.374 inches, an outer diameter of 12.75 inches and a thickness of 0.688 inch. A V-shaped weld was used composed of 308 stainless steel. Radial loads were imposed on circumferential sections of pipe having an axial length of $2\frac{1}{4}$ inches. In Location I, the load was placed symmetrically directly on the weld. In Location II, the radial load was applied on one section of the pipe away from the weld such that the distance between the midplane of the section upon which the load was applied and the weld midplane was $2\frac{3}{8}$ inches. For Location III the radial load was again applied on one section of the pipe away from the weld except that the distance between the midplane of the section upon which the load was applied and the weld midplane was $3\frac{1}{2}$ inches.

The elastic-plastic analysis was performed using a finite element computer program. In such analysis the structure is decomposed to multiple elements for which the program calculates force equilibrium conditions and compatibility of deformation. The welding stresses were simulated by trapezoidal temperature distributions along the heat-affected zones, in the weld material and in the adjacent base metal. After completion of the thermal portion of the elastic-plastic computer analysis, pressures were applied in increments from 0 to the value needed for obtaining the required reduction of pipe diameter. Pressure on the pipe was then removed.

Figure 6:
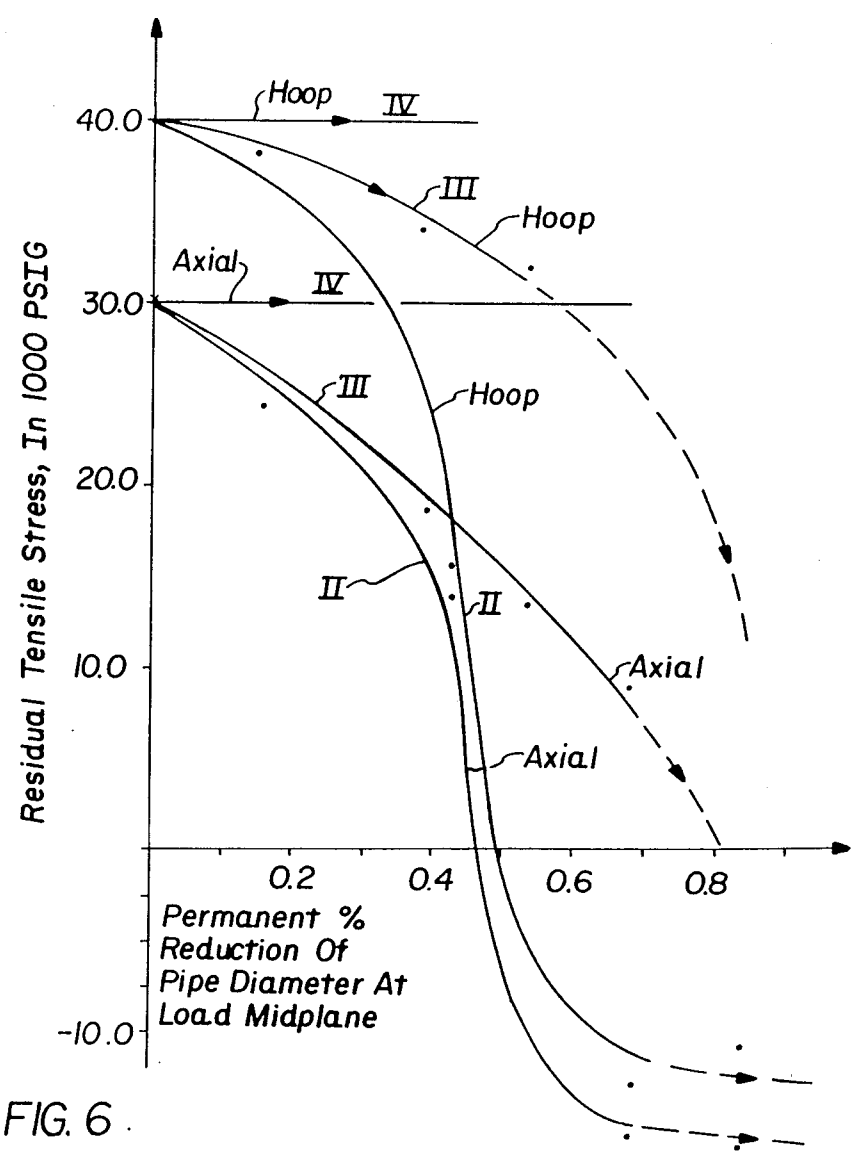
FIG. 6 is a plot showing the residual tensile stresses at the inner surface of the pipe at the weld midplane as a function of the permanent percent reduction of the pipe diameter at the midplane of the section of the pipe upon which a radial load is applied.
Figure 5:
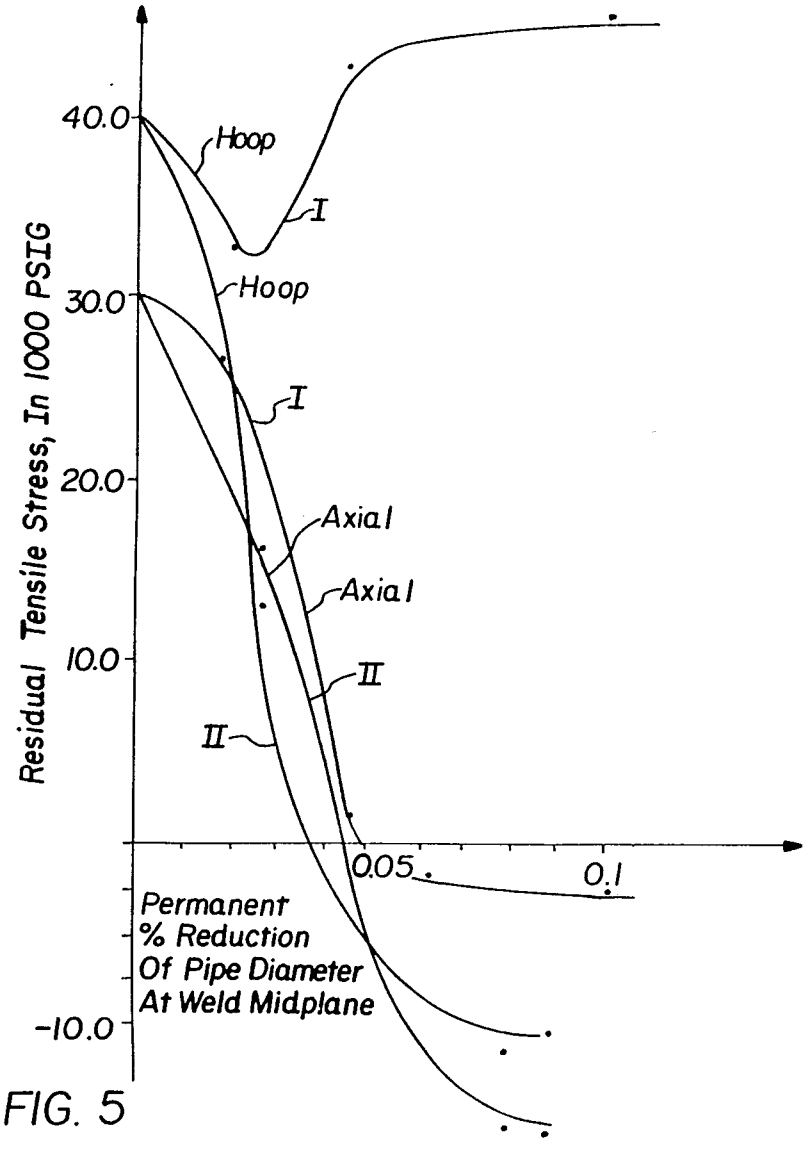
FIG. 5 is a plot showing the residual tensile stresses at the inner surface of the pipe at the weld midplane as a function of the permanent percent reduction of the pipe diameter at the weld midplane.

The data obtained are plotted in FIGS. 5 and 6. FIG. 5 shows a plot of the residual tensile stresses at the inner surface of the pipe at the weld midplane as a function of the permanent percent reduction of the pipe diameter at the weld midplane upon completion of the process. The plots show the resulting axial and hoop residual streses for Locations I and II. In Location II, which falls within our preferred process, both axial and hoop stresses are compressive, showing that the residual tensile welding stresses at the inner layer at the weld location were removed. In contrast, in Location I wherein the load was applied directly on the weld, while the axial stresses were reduced to some degree, the hoop stress remained substantially unchanged. Therefore, the residual welding stresses were not removed and the inner layer of the material at the weld midplane has not become immune to stress corrosion cracking.

FIG. 6 shows a plot of the residual tensile stresses at the inner surface of the pipe at the weld midplane as a function of the permanent percent reduction of the pipe diameter at the midplane of the section of the pipe upon which the radial load was applied. The plots show that the residual welding stresses were easily removed when the pipe diameter at the midplane of the section of the pipe upon which the radial load was applied was reduced by only about 0.5 percent. The curves for Location III show that as the distance from the weld is increased for application of radial load on the pipe, the amount of pipe diameter reduction is correspondingly increased. FIG. 6 also shows that as the location for the application of radial load on the pipe is increased to a remote location, Location IV, substantially no reduction in residual welding stresses will be obtained compared with the as-welded conditions.

Obviously, many modifications and variations of the invention, as hereinabove set forth, can be made without departing from the spirit and scope thereof, and, therefore, only such limitations should be imposed as are indicated in the appended claims.

We claim:

1. A process for removing the residual tensile welding stresses in the inner layer of the weld metal and the heat-affected zone of steel piping elements that have been butt-welded to each other end-to-end by means of a circumferential weld which comprises mechanically introducing circumferential compressive stresses in said piping elements by applying a radial load inwardly on a section of at least one said piping elements away from said weld such that the distance from the midplane of said section of said piping element upon which said radial load is applied to the weld midplane is equal to about two to about 12 times the thickness of said piping element upon which said radial load is applied, the distance from the edge of said section of said piping element upon which said radial load is applied that is adjacent said weld to the weld midplane being at least equal to about one-half the wall thickness of said piping element upon which said load is applied, the amount of said radial load being applied being sufficient to permanently reduce the outside diameter at the midplane of said section of said piping element in the range of about 0.2 to about 2.0 percent, the percent of permanent contraction of said steel piping at the midplane of said section upon which said radial load is applied being greater than the permanent contraction of said steel piping at the weld, midplane, said inner layer at the weld location assuming a concave configuration as a result of said application of said radial load.

2. The process of claim 1 wherein the thickness of said inner layer is at least about 1/10 the wall thickness of said steel piping upon which said radial load is applied.

3. The process of claim 1 wherein the thickness of said inner layer is less than about one-half the wall thickness of said steel piping upon which said radial load is applied.

4. The process of claim 1 wherein said radial load is applied inwardly on a section of at least one of said piping elements away from said weld such that the distance from the midplane of said section of said piping element upon which said radial load is applied to the weld midplane is equal to about three to about eight times the wall thickness of said piping element upon which said radial load is applied.

5. The process of claim 1 wherein the distance from the edge of said section of said piping element upon which said radial load is applied that is adjacent said weld to the weld midplane is about two to about four times the wall thickness of said piping element upon which said load is applied.

6. The process of claim 1 wherein the amount of said radial load applied to said section of said piping element is sufficient to permanently reduce the outside diameter at the midplane of said section of said piping element in the range of about 0.5 to about 1.2 percent.

7. The process of claim 1 wherein said radial load is similarly applied to a section of each of said piping elements.

8. The process of claim 1 wherein said radial load is removed from said section of said piping element.

9. The process of claim 1 wherein the wall thickness of said piping elements are not the same.

10. The process of claim 1 wherein the thickness of said inner layer is in the range of about 1/10 to about one half the wall thickness of said steel piping upon which said radial load is applied, wherein said radial load is applied inwardly on a section of at least one of said piping elements away from said weld such that the distance from the midplane of said section of said piping element upon which said radial load is applied to the weld midplane is equal to about three to about eight times the wall thickness of said piping element upon which said radial load is applied, wherein the distance from the edge of said section of said piping element upon which said radial load is applied that is adjacent said weld to said weld midplane is about two to about four times the wall thickness of said piping element upon which said load is applied and wherein the amount of said radial load applied to said section of said piping element is sufficient to permanently reduce the outside diameter at the midplane of said section of said piping element in the range of about 0.5 to about 1.2 percent.

11. The process of claim 10 wherein said radial load is similarly applied to a section of each of said piping elements.

12. The process of claim 10 wherein the percent of permanent contraction of said steel piping at the midplane of said section upon which said radial load is applied is greater than the permanent contraction of said steel piping at the weld midplane.

13. The process of claim 10 wherein said inner layer at the weld location assumes a concave configuration as a result of said application of said radial load.

14. The process of claim 10 wherein said radial load is removed from said section of said piping element.

15. The process of claim 10 wherein the wall thicknesses of said pipe elements are not the same.

* * * * *